US005299498A

United States Patent [19]

Spiegel et al.

[11] Patent Number: 5,299,498

[45] Date of Patent: Apr. 5, 1994

[54] MAGAZINE ASSEMBLY FOR AUTOMATICALLY CHANGING PRINTING PLATES

[75] Inventors: Nikolaus Spiegel, Walldorf; Hans-Georg Jahn, Wiesenbach; Hermann Beisel, Walldorf; Helmut F. Jäger, Königsbach-Stein, all of Fed. Rep. of Germany

[73] Assignee: Heidelberger Druckmaschinen AG, Heidelberg, Fed. Rep. of Germany

[21] Appl. No.: 938,897

[22] Filed: Aug. 31, 1992

[30] Foreign Application Priority Data

Aug. 31, 1991 [DE] Fed. Rep. of Germany ..... 4129022

[51] Int. Cl.[5] ..... B41L 47/14

[52] U.S. Cl. ..... 101/477; 101/415.1; 271/104

[58] Field of Search ..... 101/415.1, 368, 477, 101/127.1, 91, 369, 419, 389.1; 400/45; 406/88; 271/104, 105; 209/73; 355/85

[56] References Cited

U.S. PATENT DOCUMENTS

| | | | |
|---|---|---|---|
| 1,748,720 | 2/1930 | Lafferty | 101/477 |
| 2,414,937 | 1/1947 | Elliott | 101/477 |
| 3,817,171 | 6/1974 | Ernst, Jr. et al. | 101/369 |
| 3,938,662 | 2/1976 | Ernst, Jr. et al. | 209/73 |
| 4,255,073 | 2/1981 | Schöttle et al. | 400/45 |
| 4,334,472 | 6/1982 | Back et al. | 101/489.1 |
| 4,375,285 | 3/1983 | Dennhardt | 101/419 |
| 4,402,592 | 9/1983 | Schön et al. | 271/104 |
| 4,660,959 | 4/1987 | Schoen | 406/88 |
| 4,667,948 | 5/1987 | Angelbeck et al. | 271/105 |
| 4,727,807 | 3/1988 | Suzuki et al. | 101/415.1 |
| 4,739,701 | 4/1988 | Haug | 101/91 |
| 4,931,833 | 6/1990 | Elwing | 355/85 |
| 5,074,212 | 12/1991 | Kobler | 101/477 |
| 5,094,165 | 3/1992 | Sugiyama et al. | 101/415.1 |
| 5,107,760 | 4/1992 | Pratt | 101/127.1 |
| 5,124,745 | 6/1992 | Fischer et al. | 355/85 |
| 5,223,954 | 6/1993 | Miyakawa et al. | 358/474 |

FOREIGN PATENT DOCUMENTS

| | | | |
|---|---|---|---|
| 0268857 | 6/1988 | European Pat. Off. | 101/415.1 |
| 0411731 | 2/1991 | European Pat. Off. . | |
| 62-271744 | 11/1986 | Japan . | |
| 62-221541 | 9/1987 | Japan . | |
| 61-48834 | 11/1987 | Japan . | |
| 2127746 | 4/1984 | United Kingdom | 101/477 |

*Primary Examiner*—Eugene H. Eickholt

*Attorney, Agent, or Firm*—Herbert L. Lerner; Laurence A. Greenberg

[57] ABSTRACT

A magazine assembly for automatically changing printing plates, includes a magazine for receiving a cassette therein, a cassette receivable in the magazine and having structure for receiving a plurality of printing plates therein, and a device for removing the printing plates upon demand for feeding the printing plates to a printing cylinder of a printing unit.

8 Claims, 1 Drawing Sheet

MAGAZINE ASSEMBLY FOR AUTOMATICALLY CHANGING PRINTING PLATES

The invention relates to a magazine assembly for automatically changing printing plates.

Such a magazine assembly for automatically changing printing plates has become known heretofore from examined and published European Patent document 411 731 A2. Only a single printing plate is able to be inserted into the magazine of this heretofore known magazine assembly, which is then feedable by the magazine to a plate cylinder.

Automatization of the changing of printing plates requires, however, that a plurality of plates be held ready so that they are then available upon demand.

It is accordingly an object of the invention to provide a magazine assembly for automatically changing printing plates in which a plurality of plates are held in readiness in a magazine so that they are available upon demand.

With the foregoing and other objects in view there is provided, in accordance with the invention, a magazine assembly for automatically changing printing plates, comprising a magazine having means for receiving a cassette therein, a cassette receivable in the magazine and having means for receiving a plurality of printing plates therein, and means for removing the printing plates upon demand for feeding the printing plates to a printing cylinder of a printing unit.

In accordance with another feature of the invention, the receiving means of the magazine are vertical guides, as viewed in an upright position of the magazine, the cassette having lateral guides slidingly guidable in the vertical guides.

In accordance with further details of the invention, the lateral guides of the cassette are for slidingly receiving the printing plates therein, the cassette including holders articulatingly mounted on the lateral guides and pivotable over the printing plates into a position for securing the printing plates in the cassette from being disclosed during transport of the cassette, and stop means arranged in the magazine for pivoting the holders out of the securing position thereof during reception of the cassette in the magazine, whereby removability of the printing plates from the cassette is improved.

In accordance with another aspect of the invention, there is provided, as a subcombination of the foregoing, a cassette comprising means for guidingly inserting the cassette in a magazine, and means for receiving a plurality of printing plates therein.

In accordance with a further aspect of the invention, there is provided a base, and elements for fixing the printing plates in position on the base.

In accordance with an added aspect of the invention, the elements include positioning pins arranged on the base at a location at which the positioning pins are engageable by an edge of the printing plates initially received in the cassette.

In accordance with an additional aspect of the invention, there is provided a handle located at an upper edge of the cassette.

In accordance with yet another aspect of the invention, the receiving means comprise lateral guides for slidingly receiving the printing plates therein, and there are included holders articulatingly mounted on the lateral guides and pivotable over the printing plates for securing the printing plates against being dislodged from the cassette during transport thereof.

In accordance with a concomitant feature of the invention, the positioning pins are displaceable into and out of engagement with an outermost printing plate received in the cassette.

By providing for an assembly of the magazine and the cassette slidably received therein, in accordance with the invention, a plurality of printing plates can be transported simultaneously to a printing unit of a printing machine and placed into the magazine. The introduction and removal of the printing plates is thereby quite uncomplicated and can be performed readily without damage by providing the cassette, in accordance with the invention, with a base and elements for fixing the printing plates in position on the base, the cassette having an open side opposite the base to permit the insertion and removal of the printing plate.

Other features which are considered as characteristic for the invention are set forth in the appended claims.

Although the invention is illustrated and described herein as embodied in a magazine assembly for automatically changing printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
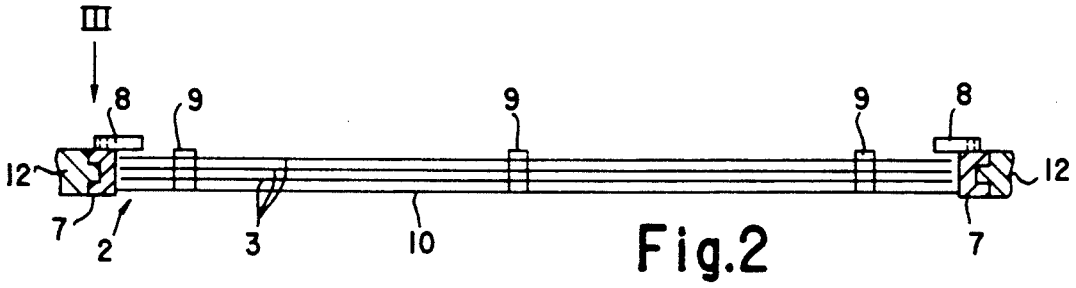
FIG. 2 is a diagrammatic sectional view along the line II—II of FIG. 1 of a cassette with printing plates mounted in guides of the magazine.
Figure 1:
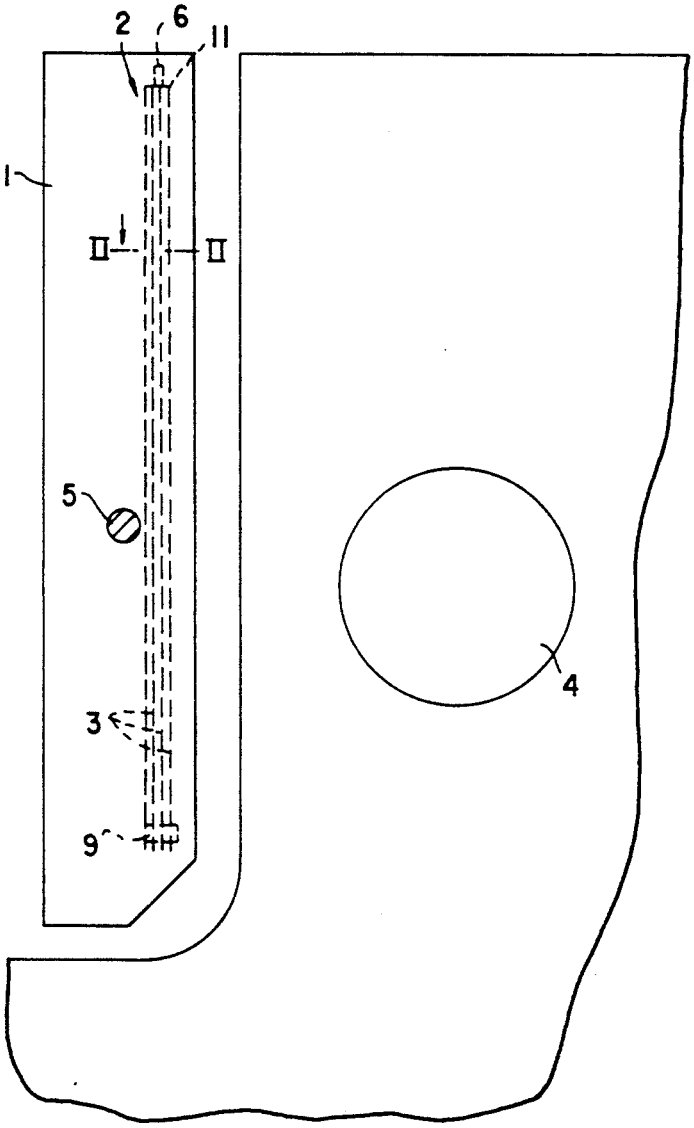
FIG. 1 is a fragmentary diagrammatic side elevational view of a printing unit of a printing machine, with a magazine according to the invention arranged thereon.
Figure 3:
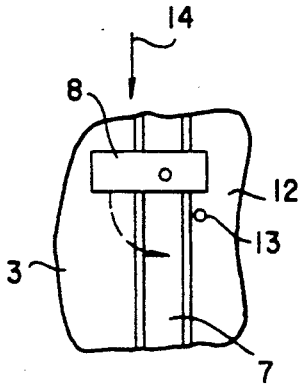
FIG. 3 is a partial view of a magazine guide as view in the direction of the arrow III in FIG. 2.

Referring now to the drawing and, first, particularly to FIG. 1 thereof, there is shown therein a magazine 1 mounted on a printing unit of a printing machine and having therein a cassette 2 which has been inserted from above into the magazine 1 and contains several printing plates 3. The magazine 1 can be displaced and can be swiveled about a horizontal swivel shaft 5 journaled in non-illustrated side frames of the printing machine so that the printing plates 3 are removable by a non-illustrated plate feeding device and feedable to plate cylinder 4 of the printing unit for clamping or fastening. In this regard, positioning pins 9, which fix the printing plates 3 in position, must be disengaged from the uppermost printing plate 3, as shown in FIG. 2. A grip or handle 6 serves as a carrying handle for transporting the cassette 2.

FIG. 2 shows the cassette 2 in a cross-sectional view taken along a plane II—II of FIG. 1 below an upper edge 11 with the handle 6. A base 10 of the cassette 2 and lateral U-shaped guides 7 are illustrated in FIG. 2, the guides 7 of the cassette 2 being slideable in vertical guides 12 of the magazine 1, as viewed in FIG. 1, when the cassette 2 is inserted and removed from the magazine 1 and placed, for example, on a table, the printing plates 3 are then placed, through an open side thereof shown at the top of FIG. 2, onto the upper side of the base 10 of the cassette 2, the guides 7 serving as lateral limits or boundaries. Holders 8 are mounted on the guides 7 and are pivotable from a position aligned with the respective guides 7 to the position thereof shown in FIG. 2 for the purpose of securing the printing plates 3 in the cassette 2 when transporting the latter. In the magazine 1, suitable stops or dogs 13 are provided, which pivot the holders 8 out of the wall i.e. out of the holding position over the outermost printing plate 3, to afford a better removability of the printing plate 3 when the cassette 3 is inserted into the magazine 1. Holes are punched at the lower edge of the printing plates 3, as viewed in FIG. 1, by means of which the printing plates 3 are inserted in precise position into and held by positioning pins 9 which are arranged at the base 10 of the cassette 2. The positioning pins 9 are disengageable from the uppermost printing plate 3 in that the pins are either partially retracted or that the plate 3 is raised. A conventional device for removing printing plates from a magazine for feeding the printing plates to a printing cylinder of a printing unit are known, for example, from U.S. Pat. No. 4,727,807 and from Japanese Patent 62-6221541(A), and the details of which have consequently not been provided in this application, as they do not, in and of themselves, constitute any part of the invention herein.

We claim:

1. In an apparatus for automatically changing printing plates, a magazine assembly comprising a magazine having means for receiving a cassette therein, a cassette receivable in said magazine and having means for receiving a plurality of printing plates therein, and means for aiding removal of the printing plates from said cassette upon demand for feeding the printing plates to a printing cylinder of a printing unit, said receiving means of said magazine being vertical guides, as viewed in an upright position of said magazine, and said cassette having laterally spaced guides sliding vertically on said vertical guides.

2. Magazine assembly according to claim 1 wherein said lateral guides of said cassette are for slidingly receiving the printing plates therein, said cassette including holders articulatingly mounted on said lateral guides and pivotable over the printing plates into a position for securing the printing plates in said cassette from being disclosed during transport of the cassette, and stop means arranged in said magazine for pivoting said holders out of said securing position thereof during reception of said cassette in said magazine, whereby removability of the printing plates from said cassette is improved.

3. In an apparatus for automatically changing printing plates of a printing cylinder of a printing unit, where the printing plates are removed from a magazine and installed on the printing cylinder upon demand, a cassette for storing a plurality of printing plates, comprising means for guidingly inserting the cassette in a magazine, and means for receiving a plurality of printing plates therein.

4. Cassette according to claim 3, having a base, and elements for fixing the printing plates in position on said base.

5. Cassette according to claim 4, wherein said elements include positioning pins arranged on said base at a location at which said positioning pins are engageable by an edge of the printing plates initially received in the cassette.

6. Cassette according to claim 3, having a handle located at an upper edge of the cassette.

7. A cassette according to claim 3, wherein said receiving means comprise lateral guides for slidingly receiving the printing plates therein, and including holders articulatingly mounted on said lateral guides and pivotable over the printing plates for securing the printing plates against being dislodged from the cassette during transport thereof.

8. A cassette according to claim 5, wherein said positioning pins are displaceable into and out of engagement with an outermost printing plate received in the cassette.

* * * * *